US011426646B2

(12) United States Patent
Riley et al.

(10) Patent No.: US 11,426,646 B2
(45) Date of Patent: Aug. 30, 2022

(54) PORTABLE MODULAR TRAINING SYSTEM

(71) Applicant: WESTERN SHELTER SYSTEMS, Eugene, OR (US)

(72) Inventors: Timothy Riley, Springfield, OR (US); Nicholas Michael Liebrecht, Eugene, OR (US); Michael W. Zahendra, Eugene, OR (US); Michael Scala, Eugene, OR (US)

(73) Assignee: WESTERN SHELTER SYSTEMS, Eugene, OR (US)

( * ) Notice: Subject to any disclaimer, the term of this patent is extended or adjusted under 35 U.S.C. 154(b) by 0 days.

(21) Appl. No.: 17/343,108

(22) Filed: Jun. 9, 2021

(65) Prior Publication Data

US 2022/0008802 A1 Jan. 13, 2022

Related U.S. Application Data

(60) Provisional application No. 63/050,952, filed on Jul. 13, 2020, provisional application No. 63/049,853, filed on Jul. 9, 2020.

(51) Int. Cl.

| | |
|---|---|
| ***A63B 71/00*** | (2006.01) |
| ***A63B 21/068*** | (2006.01) |
| ***A63B 22/06*** | (2006.01) |
| ***A63B 22/04*** | (2006.01) |
| ***B65D 90/00*** | (2006.01) |

(Continued)

(52) U.S. Cl.

CPC ..... *A63B 71/0036* (2013.01); *A63B 5/16* (2013.01); *A63B 7/04* (2013.01); *A63B 21/068* (2013.01); *A63B 21/0724* (2013.01); *A63B 22/02* (2013.01); *A63B 22/04* (2013.01); *A63B 22/0664* (2013.01); *B65D 90/00* (2013.01); *A63B 2225/105* (2013.01)

(58) Field of Classification Search

CPC ..... A63B 21/169; A63B 2210/50–56; A63B 2210/06

See application file for complete search history.

(56) References Cited

U.S. PATENT DOCUMENTS 5,046,722 A * 9/1991 Antoon ..... A63B 17/00 482/41

9,308,410 B2 4/2016 Beaver et al.

(Continued)

*Primary Examiner* — Nyca T Nguyen

(74) *Attorney, Agent, or Firm* — Saul Ewing Arnstein & Lehr LLP

(57) ABSTRACT

Portable modular training systems are described herein. In one aspect, a system includes a system container including a container front, a container rear, a container first side, a container second side, a container bottom, and a container top, an exercise structure including: at least one platform connector including: a mounting plate coupled to the system container; a first member coupled to the mounting plate and extending away from the mounting plate at a downward angle relative to the mounting plate; a second member coupled to the first member and the mounting plate and extending away from the mounting plate at an upward angle relative to the mounting plate; and a support arm coupled to the first member and the second member and extending perpendicularly away from the mounting plate; where the exercise structure is wholly supported by the system container when the exercise structure is securely associated system container.

12 Claims, 10 Drawing Sheets

(51) Int. Cl.

| | |
|---|---|
| ***A63B 7/04*** | (2006.01) |
| ***A63B 21/072*** | (2006.01) |
| ***A63B 5/16*** | (2006.01) |
| ***A63B 22/02*** | (2006.01) |

(56) References Cited

U.S. PATENT DOCUMENTS

| | | | | |
|---|---|---|---|---|
| 9,320,934 | B1 * | 4/2016 | Pringle | A63B 21/068 |
| 9,675,831 | B2 | 6/2017 | Beaver et al. | |
| 10,240,339 | B1 * | 3/2019 | Dominguez | H05K 7/1497 |
| 10,525,306 | B2 | 1/2020 | Beaver et al. | |
| 11,071,899 | B1 * | 7/2021 | Ajan | A63B 17/00 |
| 2015/0059257 | A1 * | 3/2015 | Beaver | B65D 25/20 52/27 |
| 2016/0059104 | A1 * | 3/2016 | Monaco | A63B 71/023 280/30 |
| 2016/0059105 | A1 * | 3/2016 | Scade Garcia | A63B 71/02 52/64 |
| 2017/0209733 | A1 * | 7/2017 | Beaver | B60S 9/02 |
| 2018/0028852 | A1 * | 2/2018 | Beaver | A63B 71/0036 |
| 2020/0222780 | A1 * | 7/2020 | Scala | B65D 88/121 |
| 2020/0230458 | A1 * | 7/2020 | Dery | B60R 9/08 |

* cited by examiner

PORTABLE MODULAR TRAINING SYSTEM

RELATED APPLICATIONS

This application claims priority to and benefit of the filing date of U.S. application Ser. No. 63/049,853 filed Jul. 9, 2020, and U.S. Application No. 63/050,952, filed Jul. 13, 2020, the contents of which are incorporated by reference herein in its entirety.

FIELD OF THE INVENTION

The present invention relates to a portable modular training system, and in particular to a training system that is capable of being stored in a container and deployed as desired.

BACKGROUND OF THE INVENTION

A modular training system is an exercise system that allows a user to perform one or more exercises which employ traditional bodyweight exercise, such as pull-ups, rope climbing, etc. These systems may also include accessories that support other traditional exercise platforms, such as a weight bench/support, dip bars, bungee hooks, jumping platforms, etc. Unfortunately however, these types of systems are typically fixed in place and once assembled tend to be a permanent structure that occupies a dedicated space. This is undesirable for situations where the system is moved frequently, or where there is limited dedicated space available for exercising.

One solution to the dedicated space issue is a training system that is configured to be stowable within a container and easily deployable for use. A standard forty foot (40') shipping container is usable for this purpose. Thus, for situations where a dedicated exercise space is either limited or unavailable, the container allows the exercise equipment to be stored when not in use. Additionally, the container may be movable. This is advantageous because it allows the modular training system to be easily stowed within the container, moved and deployed when being used. This is particularly useful for areas that cannot have a dedicated exercise area or for situations where the exercise location is relocated multiple times, such as with military situations.

Many current designs require that the modular training system be supported, at least partially, via the ground. This is undesirable because these such training systems cannot be used in areas where the ground is not level or stable, without building an extraneous support platform to support the training system.

SUMMARY

Portable modular training systems are described herein. In one aspect, a modular training system can include a system container including a container front, a container rear, a container first side, a container second side, a container bottom, and a container top, wherein the container front, the container rear, the container first side, the container second side, the container rear, and the container top define a container cavity; an exercise structure including: at least one platform connector including: a mounting plate coupled to the system container; a first member coupled to the mounting plate and extending away from the mounting plate and at a downward angle relative to the mounting plate; a second member coupled to the first member and the mounting plate and extending away from the mounting plate at an upward angle relative to the mounting plate; and a support arm coupled to the first member and the second member and extending perpendicularly away from the mounting plate; where the exercise structure is wholly supported by the system container when the exercise structure is securely associated system container.

This aspect can include a variety of embodiments. In one embodiment, the first member terminates at a coupling between the first member and the support arm.

In another embodiment, the second member terminates at a coupling between the second member and the first member, at a coupling between the second member and the support arm, or both.

In another embodiment, the upward angle is a 45 degree angle.

In another embodiment, the downward angle is a 45 degree angle.

In another embodiment, when the exercise structure is connected to the system container, the exercise structure does not contact the ground surface.

In another embodiment, the exercise structure further includes at least one of a pull-up bar, a dip bar, a climbing rope, a weight/bench support, a universal weight system, a bungee hook, a jumping platform, a treadmill, an elliptical, and a stair climber.

In another aspect, a modular training system can include a system container including a container front, a container rear, a container first side, a container second side, a container bottom, and a container top, where the container front, the container rear, the container first side, the container second side, the container rear, and the container top define a container cavity; an exercise structure including: at least one platform connector including: a vertical support bar coupled to an interior surface of the system container; and a horizontal bar coupled to the vertical support bar and extending external to the system container via an aperture defined by the system container; where the exercise structure is wholly supported by the system container when the exercise structure is securely associated system container.

This aspect can include a variety of embodiments. In one embodiment, the vertical support bar is coupled to the container ceiling and the container floor.

In another embodiment, the horizontal bar does not contact the system container.

In another embodiment, the exercise structure further includes at least one of a pull-up bar, a dip bar, a climbing rope, a weight/bench support, a universal weight system, a bungee hook, a jumping platform, a treadmill, an elliptical, and a stair climber.

In another aspect, a modular training system can include a system container including a container front, a container rear, a container first side, a container second side, a container bottom, and a container top, where the container front, the container rear, the container first side, the container second side, the container rear, and the container top define a container cavity; an exercise structure including: at least one platform connector including: an interior vertical support bar coupled to an interior surface of the system container; a horizontal bar coupled to the interior vertical support bar and extending external to the system container via an aperture defined by the system container; and an exterior vertical support bar coupled to the horizontal bar external to the system container.

This aspect can include a variety of embodiments. In one embodiment, the exterior vertical support bar is coupled to the container ceiling and the container floor.

In another embodiment, the horizontal bar does not contact the system container.

In another embodiment, the exercise structure further includes at least one of a pull-up bar, a dip bar, a climbing rope, a weight/bench support, a universal weight system, a bungee hook, a jumping platform, a treadmill, an elliptical, and a stair climber.

In another aspect, a modular training system can include a system container including a container front, a container rear, a container first side, a container second side, a container bottom, and a container top, where the container front, the container rear, the container first side, the container second side, the container rear, and the container top define a container cavity; an exercise structure including: at least one platform connector including: an interior vertical support bar coupled to an interior surface of the system container; an interior horizontal support bar coupled to the interior vertical support bar and disposed within the container cavity; an exterior horizontal bar coupled to the interior vertical support bar and extending external to the system container via an aperture defined by the system container; and an exterior vertical support bar coupled to the horizontal bar external to the system container.

This aspect can include a variety of embodiments. In one embodiment, the exterior vertical support bar is coupled to the container ceiling and the container floor.

In another embodiment, the horizontal bar does not contact the system container.

In another embodiment, the exercise structure further includes at least one of a pull-up bar, a dip bar, a climbing rope, a weight/bench support, a universal weight system, a bungee hook, a jumping platform, a treadmill, an elliptical, and a stair climber.

In another aspect, a modular training system can include a system container including a container front, a container rear, a container first side, a container second side, a container bottom, and a container top, where the container front, the container rear, the container first side, the container second side, the container rear, and the container top define a container cavity; an exercise structure including: at least one platform connector including: a mounting plate coupled to the system container; a first member coupled to the mounting plate and extending away from the mounting plate and at a downward angle relative to the mounting plate; a second member coupled to the first member and the mounting plate and extending away from the mounting plate at an upward angle relative to the mounting plate; and a support arm coupled to the first member and the second member and extending perpendicularly away from the mounting plate; and an exterior vertical bar coupled to the at least one platform connector via a horizontal bar and including a telescoping foot configured to not be contact with a support surface when in a retracted state, and to be in contact with the support surface when in an extended state, where the system container rests on the support surface.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike in the several figures.

DETAILED DESCRIPTION

Figure 1A:
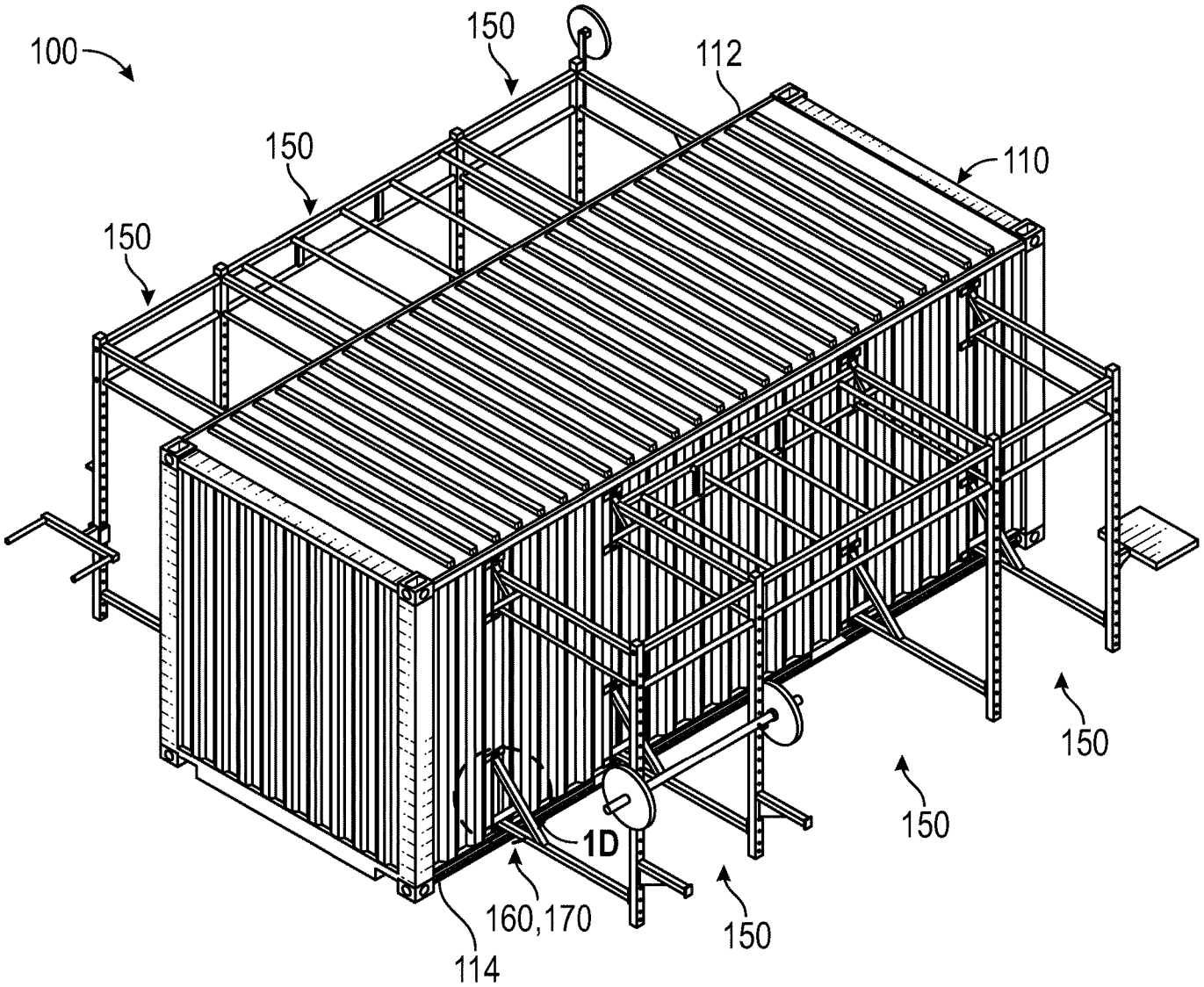
FIG. 1A shows a perspective view of a modular training system according to a first embodiment of the present disclosure.
Figure 1B:
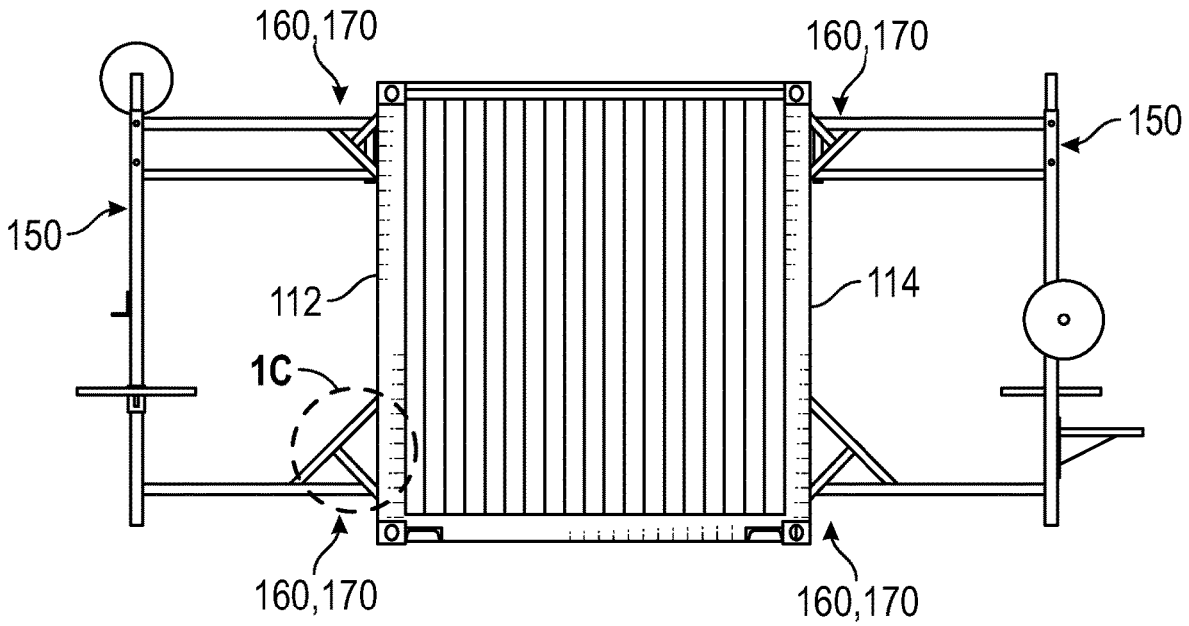
FIG. 1B shows a front view of modular training system according to the first embodiment of the present disclosure.

FIG. 1A shows a modular training system 100 according to a first embodiment of the present disclosure which includes a container 110 and one or more exercise structures 150 coupled thereto. In the embodiment shown in FIG. 1A, at least two exercise structures 150 are coupled to the container 110: one coupled to a left side 112 of the container, and one coupled to a right side 114 of the container. The exercise structures 150 may be coupled to the container 110 through one or more exterior wall mounts 160, along with one or more brackets 170. The specifics of the exterior wall mounts 160 and brackets 170 are shown in more detail in FIGS. 1C and 1D. FIG. 1B shows a front view of the modular training system 100. Preferably, each exercise structure 150 is secured by both upper and lower brackets 170. As explained further below, the brackets 170 allow the exercise structures 150 to be suspended from the ground, thereby avoiding any support issues created by uneven surfaces (on which the container 110 rests).

Figure 1C:
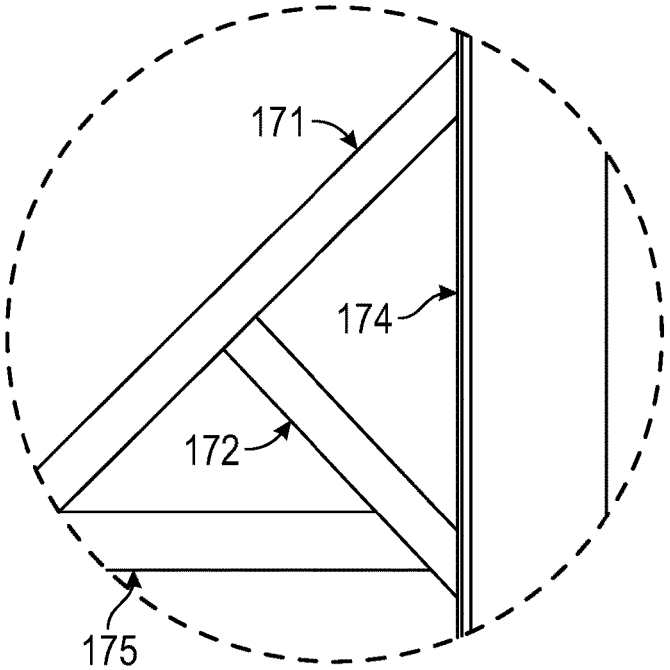
FIG. 1C shows a first detail view of modular training system according to the first embodiment of the present disclosure.

As shown in FIG. 1C, each bracket 170 comprises a first member 171, a second member 172, a mounting plate 174, and a support arm 175. The first member 171 is angled downwards and away from the mounting plate 174 and the side of the container (e.g., right side 114) by a forty-five degree (45°) angle. The second member 172 is angled upwards and away from the side of the container (e.g., right side 114) by a forty-five degree (45°) angle. The second member 172 is coupled to the first member 171 about halfway between the opposing ends of the first member. The support arm 175 is coupled to both the first member 171 and the second member 172. However, the support arm 175 does not contact the side of the container (e.g., right side 114); it only contacts the second member 172. The first member 171, second member 172, mounting plate 174 and support arm 175 may be coupled to each other by welding or other known means.

Figure 1D:
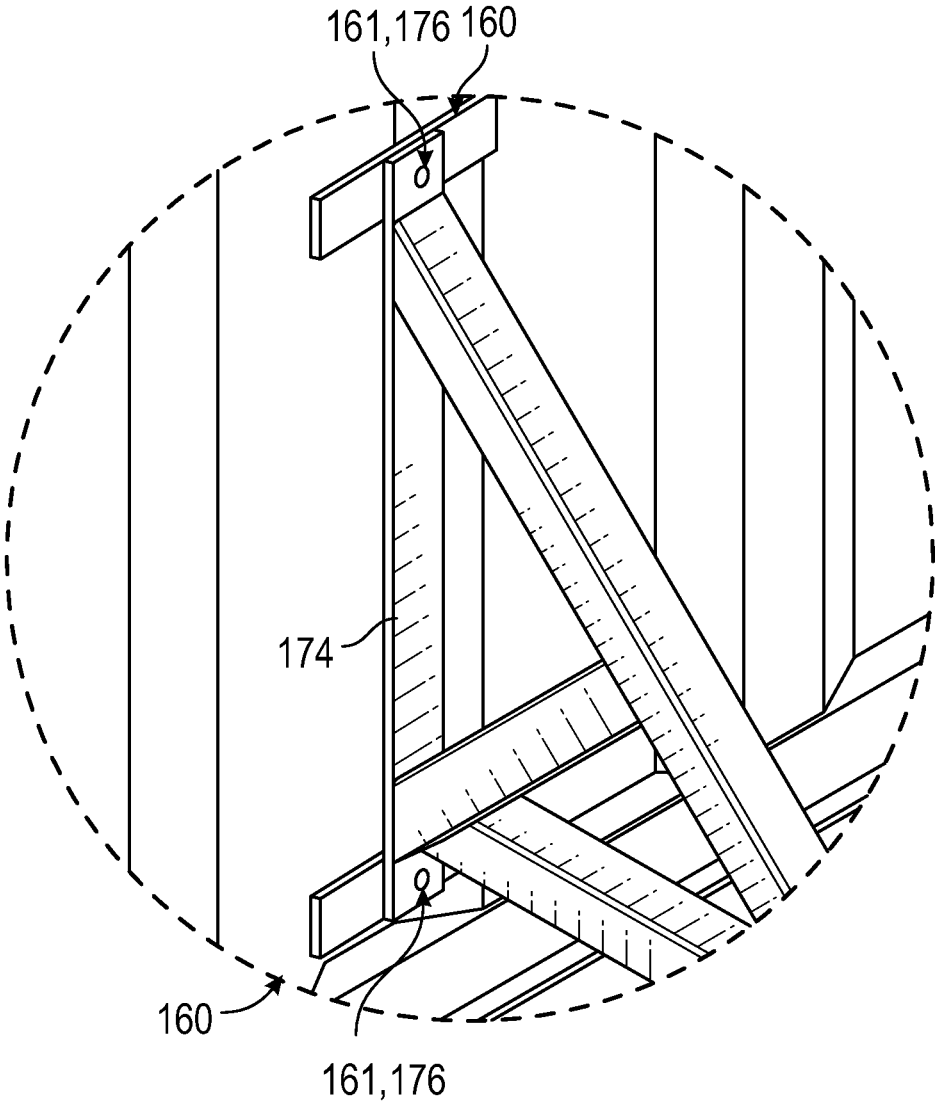
FIG. 1D shows a second detail view of modular training system according to the first embodiment of the present disclosure.

Each bracket 170 may be coupled to one or more exterior wall mounts 160, which are in turn coupled to the side of the container (e.g., right side 114). The exterior wall mounts 160 may be welded to the side of the container (e.g., right side 114), or attached through other fastening means known to those of ordinary skill in the art (e.g., screws). The exterior wall mounts 160 are preferably long enough to span the corrugated recesses in the sides of the container 110. A single bracket 170 may be secured by two or more exterior wall mounts 160, as shown in FIG. 1D. Each exterior wall mount 160 preferably includes a centrally-located threaded opening 161 (obstructed from view by fastening means) for receiving a screw or other similar fastening means. Each bracket 170 includes at least two openings 176 (obstructed from view by fastening means) for receiving a threaded fastener (e.g., screw), and securing the bracket 170 to the exterior wall mounts 160, as shown in FIG. 1D. The brackets 170 support the entire weight of each exercise structure 150, such that no portion of the exercise structure requires contact with the ground for support. FIG. 1B shows the approximate clearance between the lowest portion of each exercise structure 150 and the ground (e.g., 4 inches).

The modular training system 100 preferably includes the ability to store all of the exercise structures 150, exterior wall mounts 160 and brackets 170 within the container 110, so that the container may be easily transported from one location to another. The exercise structures 150 may include pull-up bars, squat racks, wall-ball targets, box jump platforms, and the like. Additionally, the exercise structures 150 may be set up and attached to the container 110 with minimal manpower and basic tools. The container 110 may be an International Organization for Standardization (ISO) standardized shipping container, intermodal container, or the like. The container 110 may include internal storage racks for storing the exercise structures 150, exterior wall mounts 160 and brackets 170, as well as barbells and other similar exercise items.

Figure 2A:
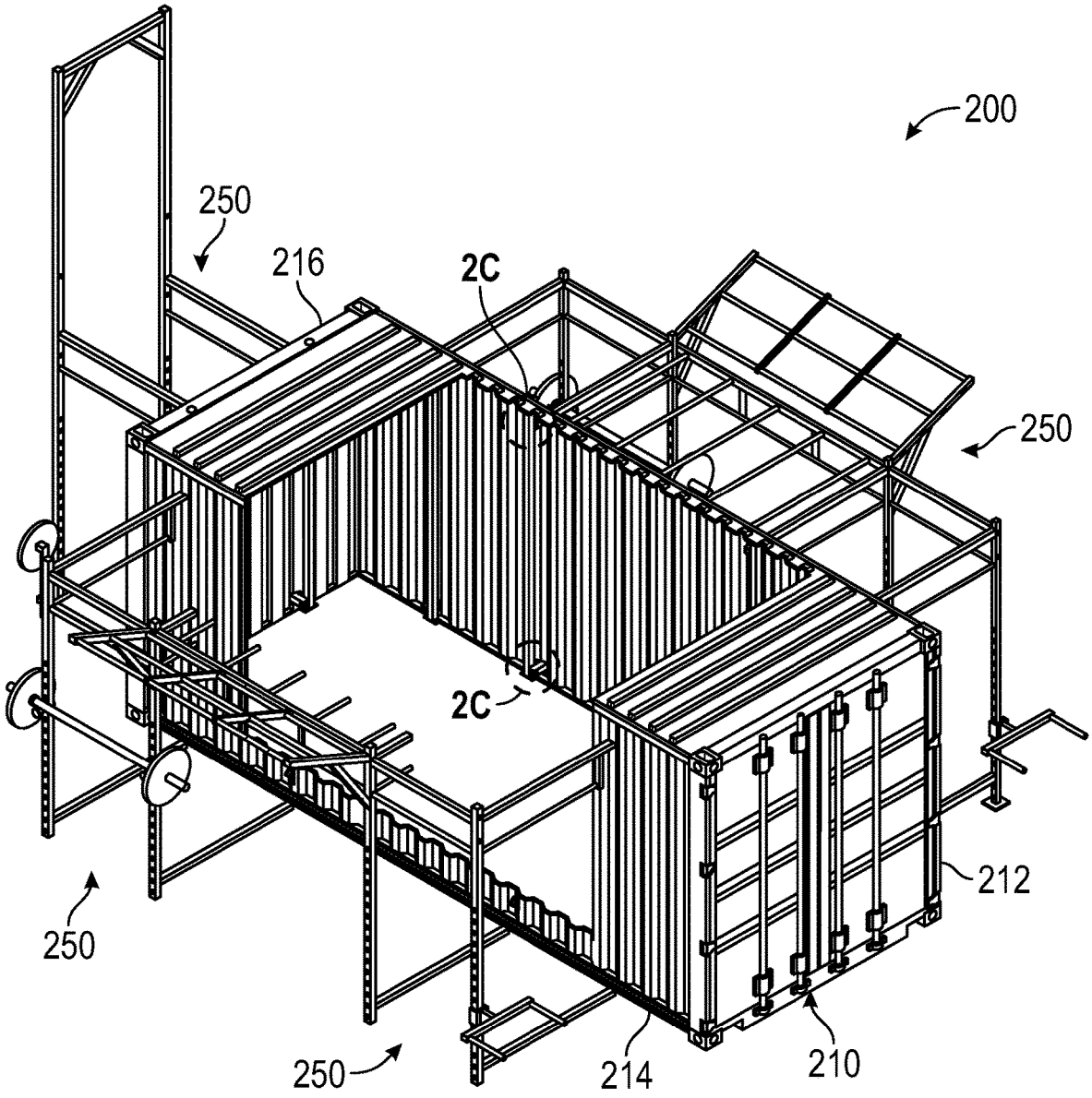
FIG. 2A shows a perspective view of a modular training system according to a second embodiment of the present disclosure.
Figure 2B:
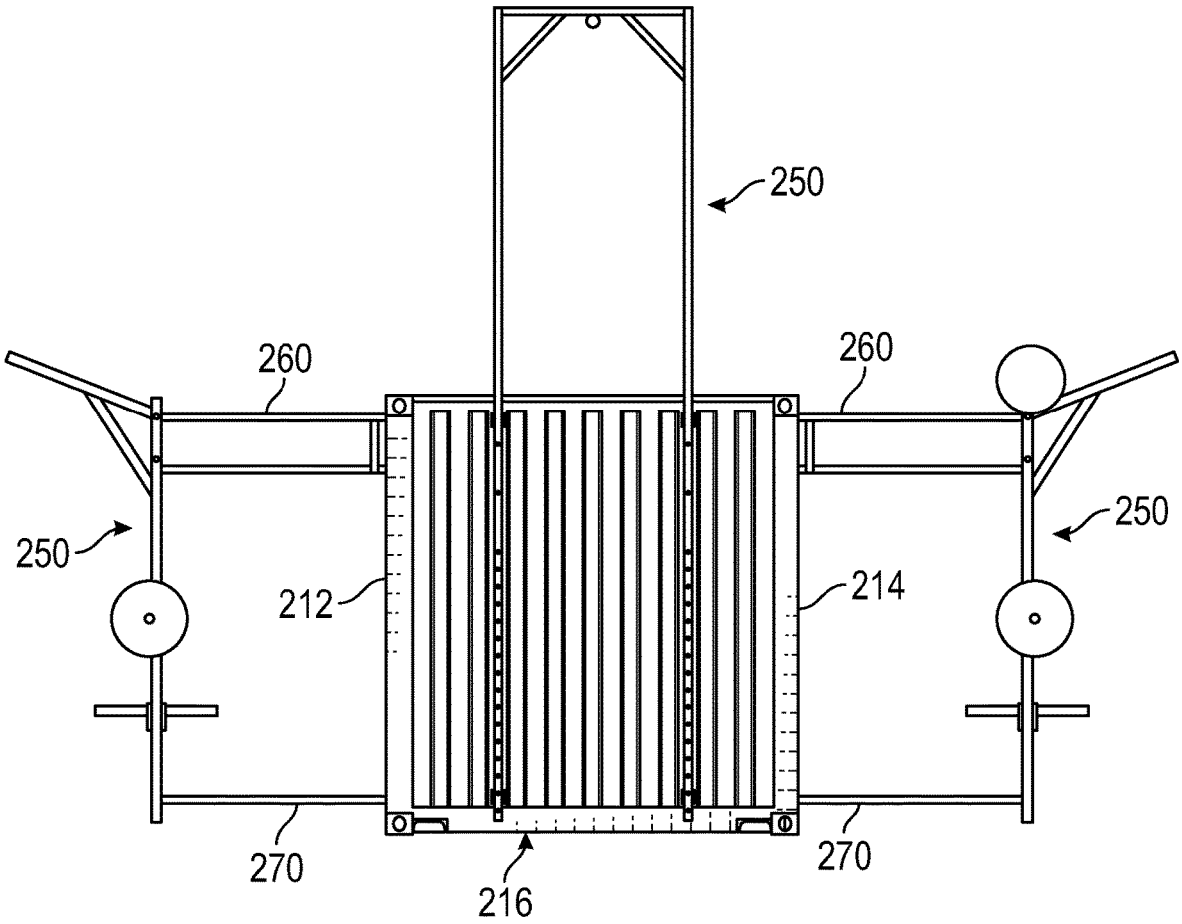
FIG. 2B shows a front view of modular training system according to the second embodiment of the present disclosure.

FIG. 2A shows a modular training system 200 according to a second embodiment of the present disclosure which includes a container 210 and one or more exercise structures 250 coupled thereto. In the embodiment shown in FIG. 2A, at least three exercise structures 250 are coupled to the container 210: one coupled to a left side 212 of the container, one coupled to a right side 214 of the container, and one coupled to a front side 216 of the container. FIG. 2B shows a front view of the container 210 with the exercise structures attached thereto.

Figure 2C:
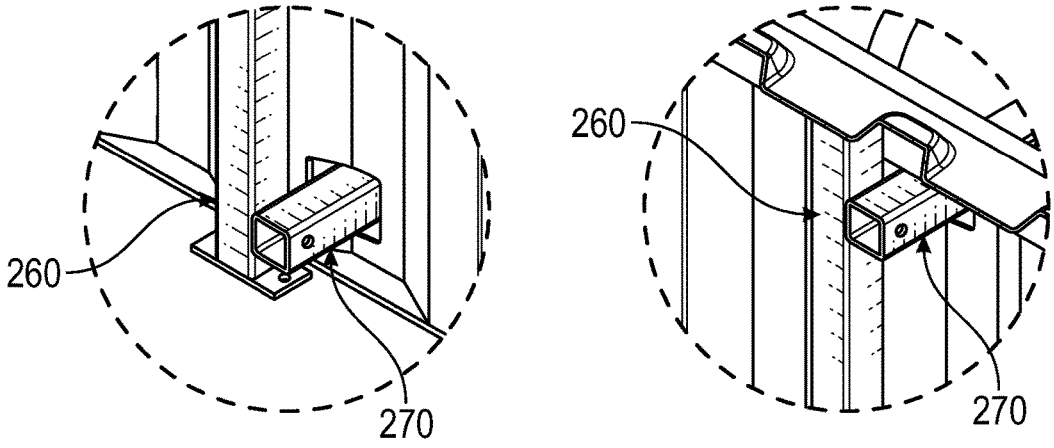
FIG. 2C shows a first detail view of modular training system according to the second embodiment of the present disclosure.

The exercise structures 250 may be coupled to the container 210 through one or more interior vertical support bars 260. These interior vertical support bars are spaced throughout the interior of the container 210, and can be each coupled to both the floor of the container and the ceiling. One or more horizontal support bars 270 may be coupled to each interior vertical support bar 260 to support each exercise structure 250. The horizontal support bars 270 may be adapted to pass through openings 275 in the walls of the container 210 that are in close proximity to the interior vertical support bars 260. Each horizontal support bar 270 may be coupled to a respective vertical support bar 260 at a specific point, as shown in FIG. 2C. Importantly, no portion of the horizontal support bars 270 contact the side of the container (e.g., right side 214). This allows the exercise structures 250 to be fully supported by the vertical support bars 260, and reduces stress and strain on the sides of the container. The interior vertical support bars 260 support the entire weight of each exercise structure 250, such that no portion of the exercise structure needs to contact the ground for support. FIG. 2B shows the approximate clearance between the lowest portion of each exercise structure 250 and the ground (e.g., 4 inches).

Figure 3A:
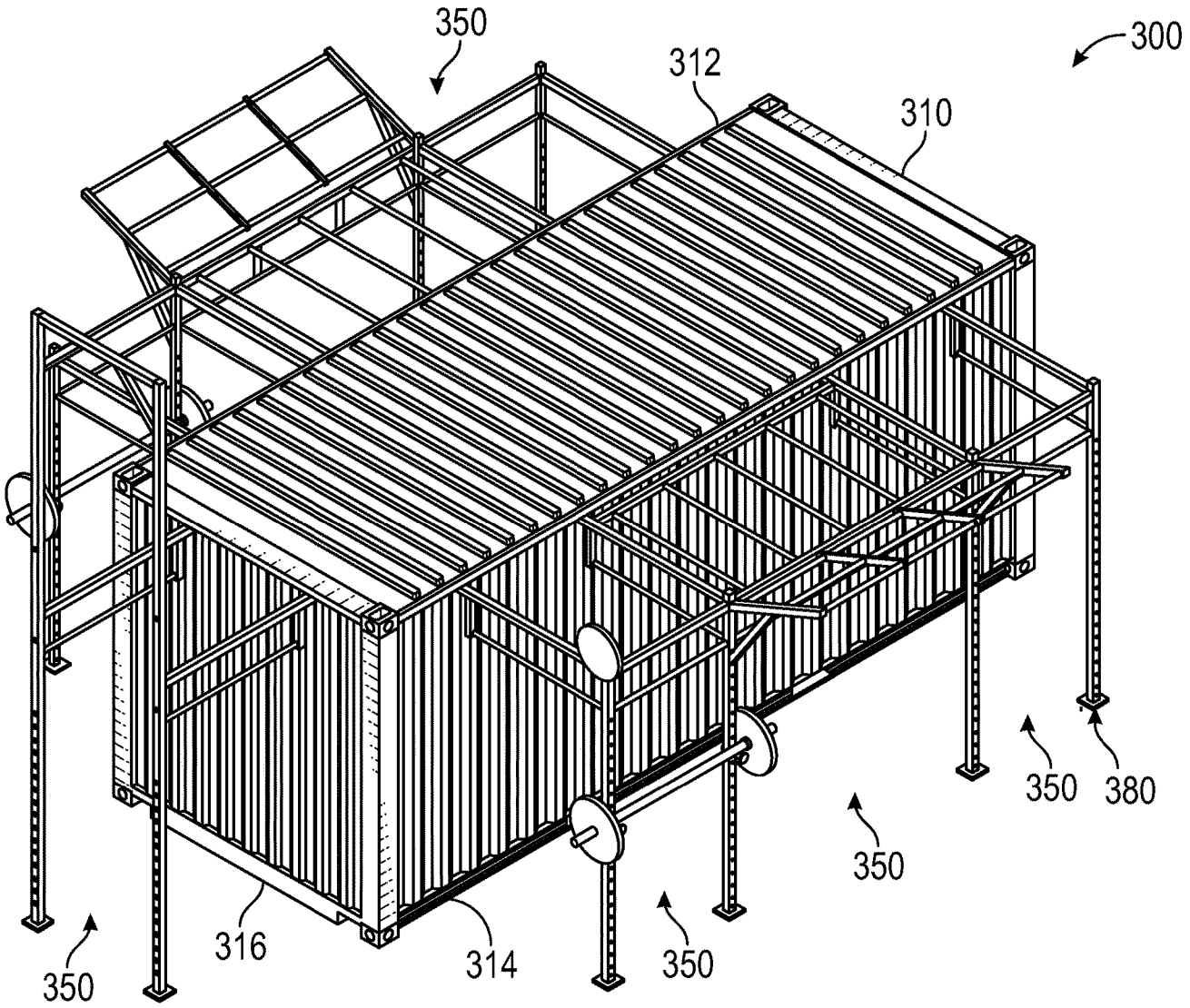
FIG. 3A shows a perspective view of a modular training system according to a third embodiment of the present disclosure.
Figure 3B:
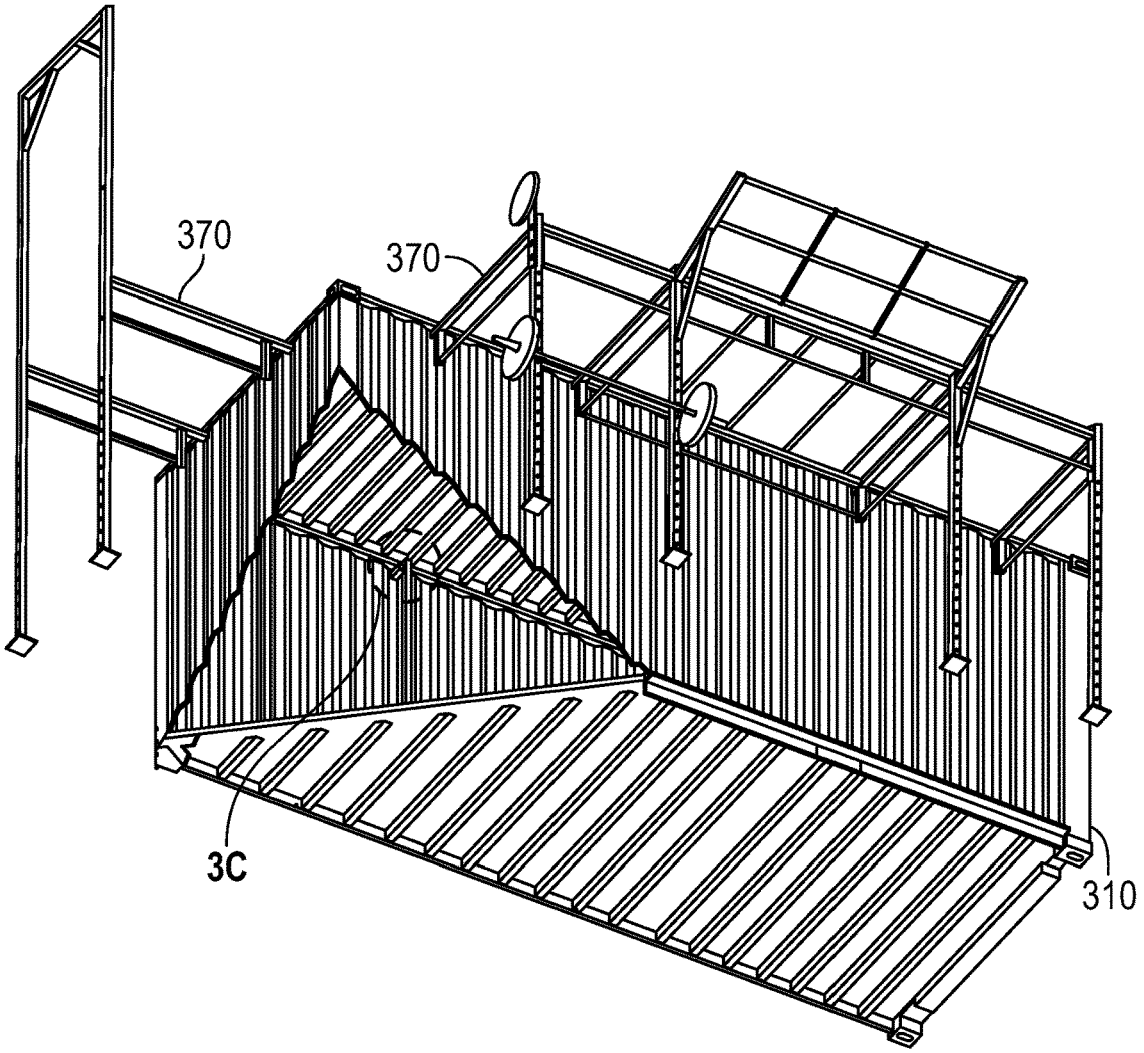
FIG. 3B shows an underneath perspective view of modular training system according to the third embodiment of the present disclosure.

FIG. 3A shows a modular training system 300 according to a third embodiment of the present disclosure which includes a container 310 and one or more exercise structures 350 coupled thereto. In the embodiment shown in FIG. 3A, at least three exercise structures 350 are coupled to the container 310: one coupled to a left side 312 of the container, one coupled to a right side 314 of the container, and one coupled to a front side 316 of the container. FIG. 3B shows a partial cutaway perspective view (from underneath) of the container 310 with the exercise structures attached thereto.

Figure 3C:
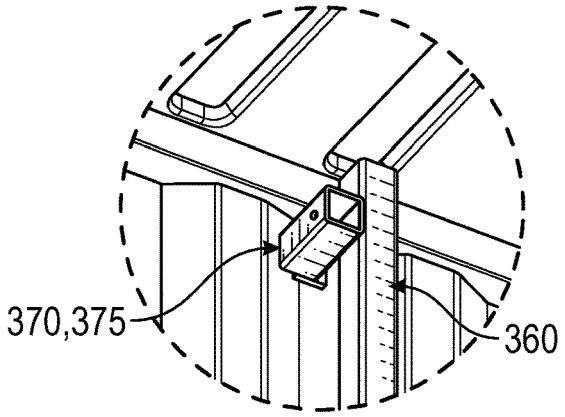
FIG. 3C shows a first detail view of modular training system according to the third embodiment of the present disclosure.

The exercise structures 350 may be coupled to the container 210 through one or more interior vertical support bars 360. These interior vertical support bars 360 are spaced throughout the interior of the container 310, and are preferably each coupled to both the floor of the container, and the ceiling. One or more horizontal support bars 370 may be coupled to each interior vertical support bar 360 to support each exercise structure 350. The horizontal support bars 370 may be adapted to pass through openings 375 in the walls of the container 310 that are in close proximity to the interior vertical support bars 360. Each horizontal support bar 370 may be coupled to a respective vertical support bar 360 at a specific point, as shown in FIG. 3C.

As opposed to the second exemplary embodiment discussed above, the training system 300 includes exterior vertical support bars 380 that contact the ground for additional support. Additionally, the lower set of horizontal support bars 270 shown in the second exemplary embodiment are removed, as the exterior vertical support bars 380 provide support for the lower portions of the exercise structures 350.

Figure 4A:
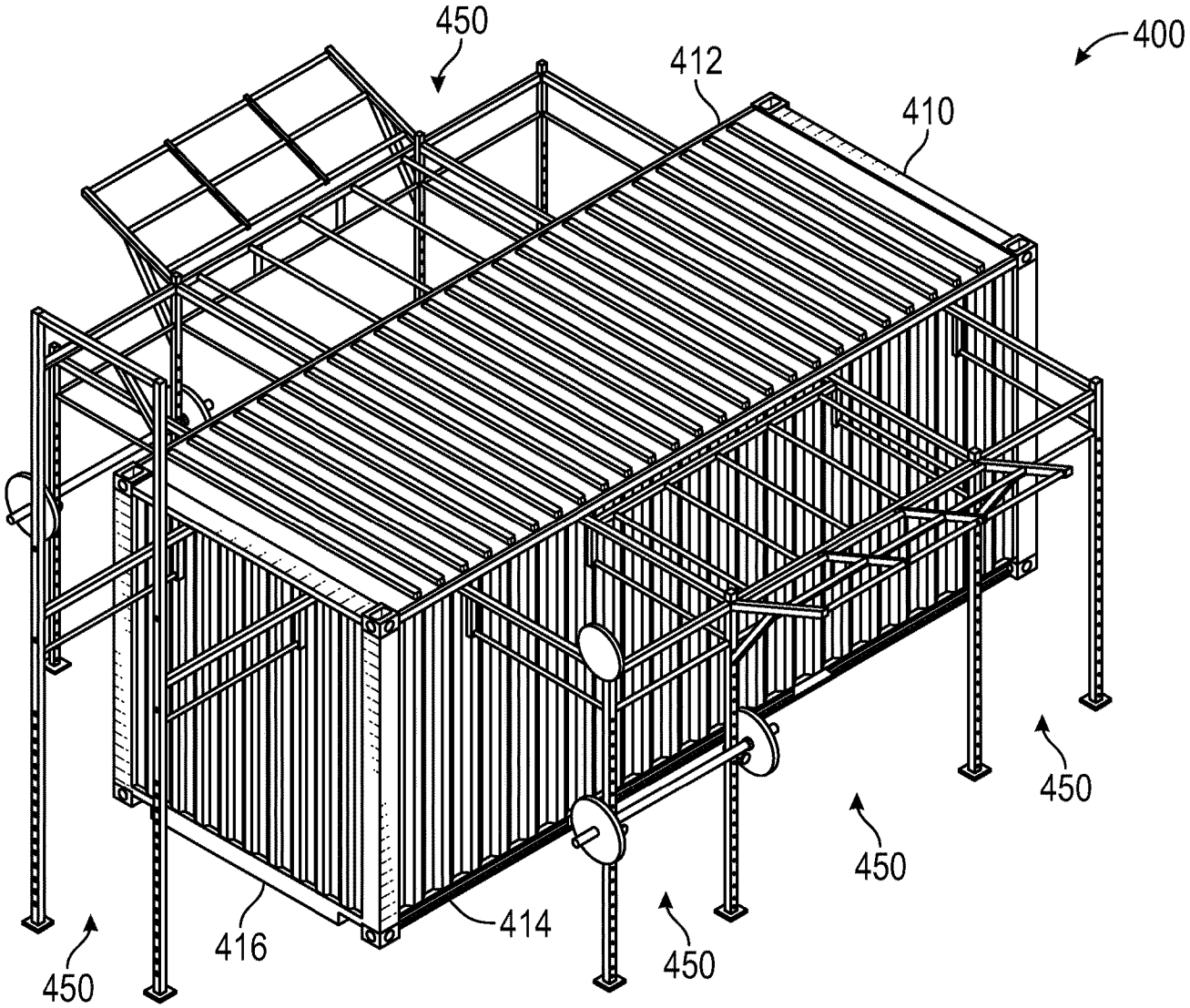
FIG. 4A shows a perspective view of a modular training system according to a fourth embodiment of the present disclosure.

FIG. 4A shows a modular training system 400 according to a fourth embodiment of the present disclosure which includes a container 410 and one or more exercise structures 450 coupled thereto. In the embodiment shown in FIG. 4A, at least three exercise structures 450 are coupled to the container 410, one coupled to a left side 412 of the container, one coupled to a right side 414 of the container, and one coupled to a front side 416 of the container.

Figure 4B:
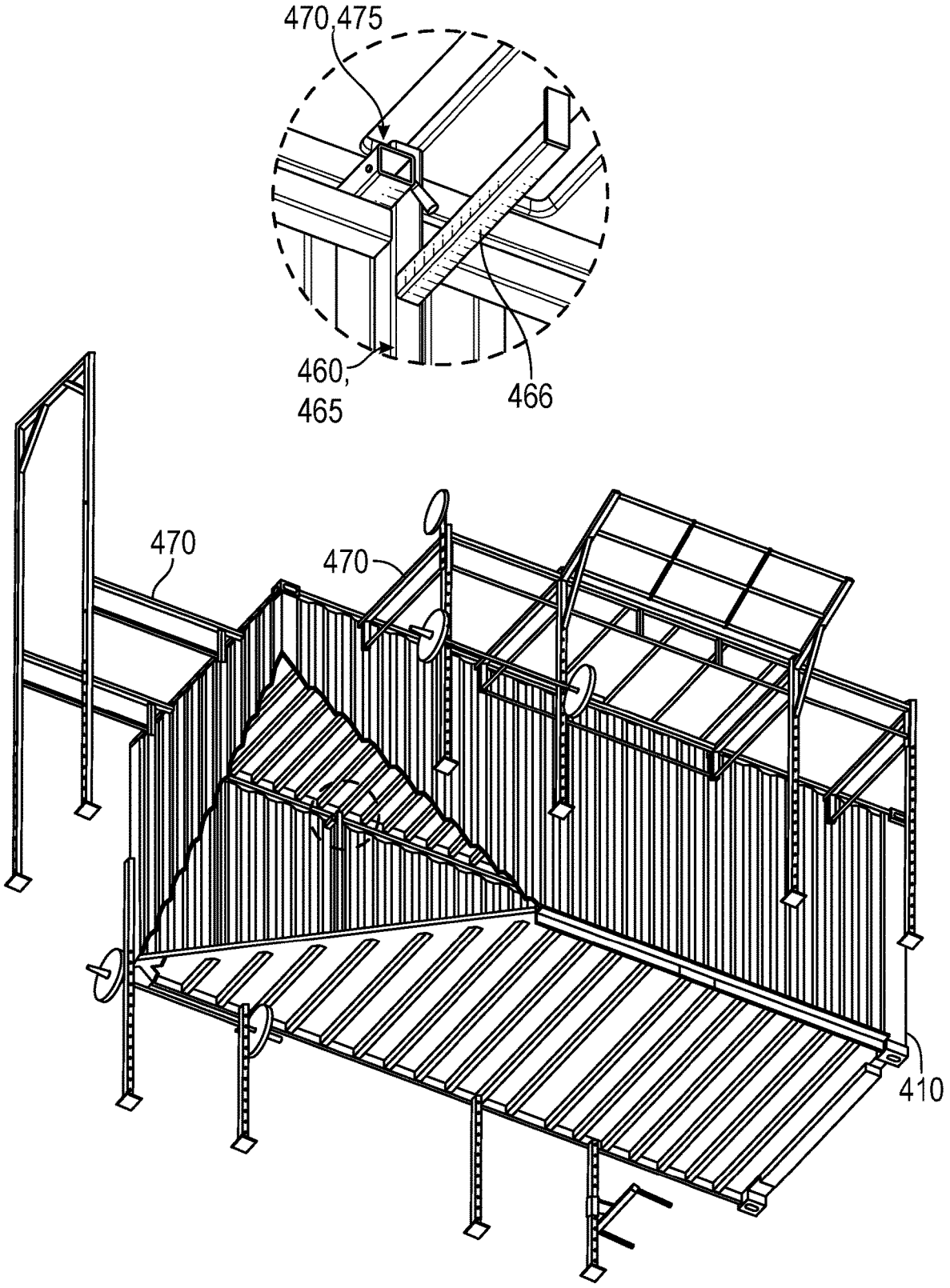
FIG. 4B shows an underneath perspective view of modular training system according to the fourth embodiment of the present disclosure.

FIG. 4B shows a partial cutaway perspective view (from underneath) of the container 410 with the exercise structures attached thereto by way of an internal skeleton 460. The internal skeleton 460 is formed by a plurality of vertical support bars 465, and a plurality of horizontal support bars 466 extending therebetween. The internal skeleton 460 provides a support structure for supporting the exercise structures. Much like the second and third exemplary embodiments, the training system 400 includes horizontal support bars 470 that may be adapted to pass through openings 475 in the walls of the container 410 that are in close proximity to the vertical support bars 465 of the internal skeleton 460. Each horizontal support bar 470 may be coupled to a respective vertical support bar 465 of the internal skeleton 460 at a specific point, as shown in FIG. 4B. As opposed to the second exemplary embodiment discussed above, the training system 400 includes exterior vertical support bars 480 that contact the ground for additional support.

Figure 5B:
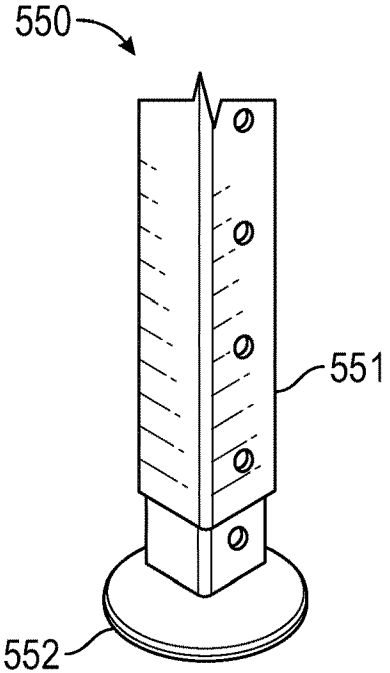
FIG. 5B shows a detail view of modular training system according to the fifth embodiment of the present disclosure.
Figure 5A:
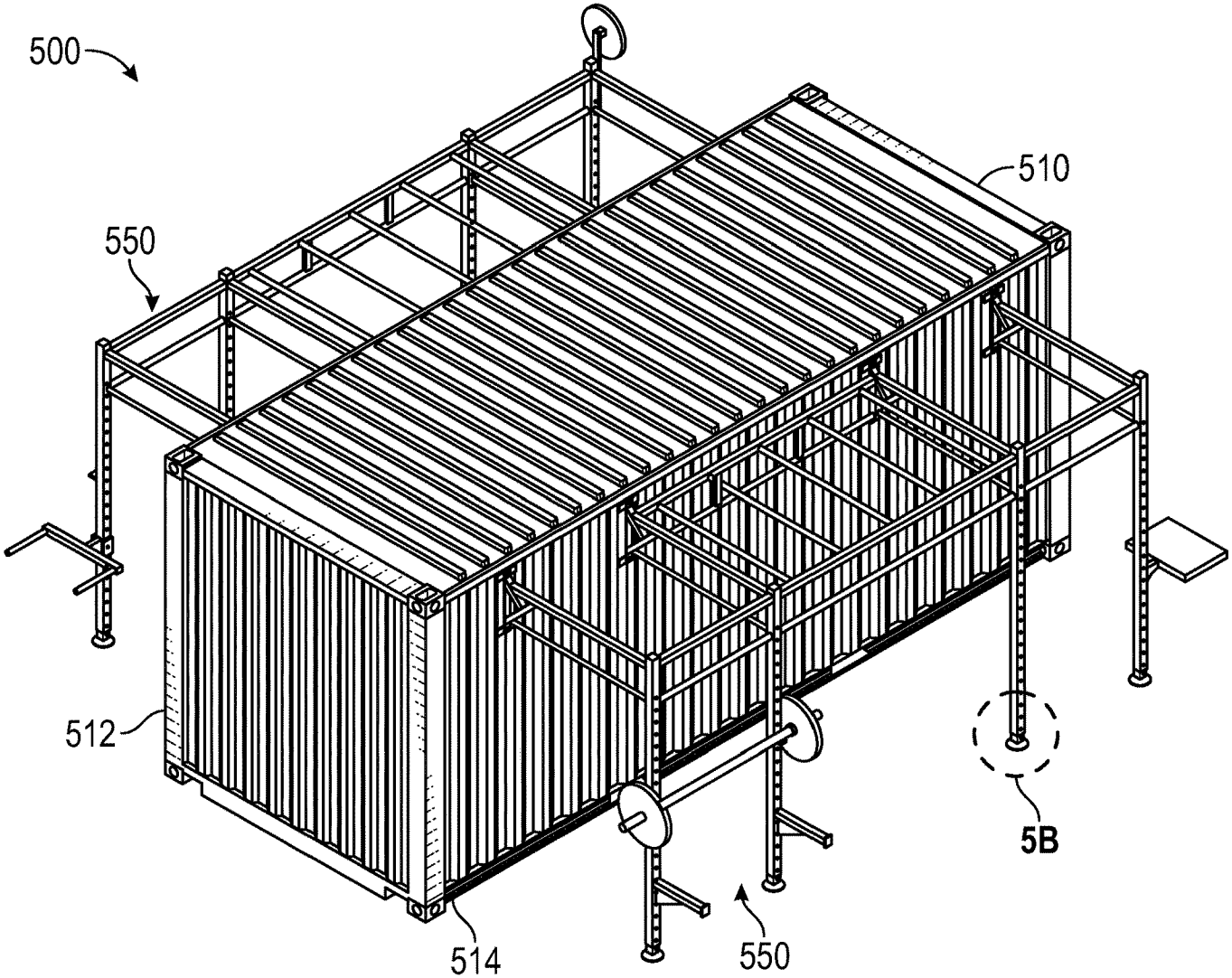
FIG. 5A shows a perspective view of a modular training system according to a fifth embodiment of the present disclosure.

FIG. 5A shows a modular training system 500 according to a fifth embodiment of the present disclosure which includes a container 510 and one or more exercise structures 550 coupled thereto. In the embodiment shown in FIG. 5A, at least two exercise structures 550 are coupled to the container 510: one coupled to a left side 512 of the container, and one coupled to a right side 514 of the container. The exercise structures 550 may be coupled to the container 510 through one or more exterior wall mounts 560, along with one or more brackets 570. The specifics of the exterior wall mounts 560 and brackets 570 are the same as for the wall mounts 160 and brackets 170 shown in FIGS. 1C and 1D, in connection with the first embodiment. As previously explained, the brackets 570 allow the exercise structures 550 to be suspended from the ground.

FIG. 5B shows a detail view of one of the exercise structures 550. Specifically, FIG. 5B shows a lower portion of one exercise structures 550, which includes a fixed leg 551 and a telescoping foot 552. In the exemplary embodiment shown in FIG. 5B, each exercise structure 550 has two fixed legs 551 and two corresponding telescoping feet 552. Since the telescoping feet 552 are not required for support of the exercise structures 550, they may be set in a retracted state spaced away from the surface on which the container 510 rests. Alternatively, the telescoping feet 552 may be set to contact the surface on which the container rests (e.g., the ground), to provide additional support for the exercise structures 550. As is known to the those of ordinary skill in the art, the telescoping feet 552 may include one or more spring-loaded protrusions which may extend through openings in the fixed legs 551, to thereby set the telescoping feet to different set heights.

As with the modular training system 100 according to the first embodiment, each of the modular training systems 200, 300, 400 and 500 preferably include the ability to store all of the exercise structures (250, 350, 450, 550), and related structural elements within the containers (210, 310, 410, 510), so that the container may be easily transported from one location to another. The exercise structures (250, 350, 450, 550) may include pull-up bars, squat racks, wall-ball targets, box jump platforms, more. Additionally, the exercise structures (250, 350, 450, 550) may be set up and attached to the containers (210, 310, 410, 510) with minimal manpower and basic tools. The containers (210, 310, 410, 510) may be an International Organization for Standardization (ISO) standardized shipping container, intermodal container, or the like. For example, the containers (210, 310, 410, 510) may be composed of steel (e.g., A36 grade), aluminum, composites, and the like. In some cases, the containers (210, 310, 410, 510) may include ISO-standardized sizing, such as 8.5'×20'; 8'×20; 108"×88"×91.35"; 10'×8.5'×8'; 8'×6.5'×8'; and the like. The containers (210, 310, 410, 510) may include internal storage racks for storing the exercise structures (250, 350, 450, 550), related structural components, as well as barbells and other similar exercise items.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

An apparatus and system as described above with reference to the foregoing description and appended drawings is hereby claimed.

The invention claimed is:

1. A modular training system, comprising:

a system container including a container front, a container rear, a container first side, a container second side, a container bottom, and a container top, wherein the container front, the container rear, the container first side, the container second side, the container rear, and the container top define a container cavity;

an exercise structure comprising:

at least one platform connector comprising:

a mounting plate coupled to the system container;

a first member coupled to the mounting plate and extending away from the mounting plate and at a downward angle relative to the mounting plate;

a second member coupled to the first member and the mounting plate and extending away from the mounting plate at an upward angle relative to the mounting plate; and a support arm coupled to the first member and the second member and extending perpendicularly away from the mounting plate;

wherein the exercise structure is wholly supported by the system container when the exercise structure is securely associated with the system container.

2. The modular training system of claim 1, wherein the first member terminates at a coupling between the first member and the support arm.

3. The modular training system of claim 1, wherein the second member terminates at a coupling between the second member and the first member, at a coupling between the second member and the support arm, or both.

4. The modular training system of claim 1, wherein the upward angle comprises a 45 degree angle.

5. The modular training system of claim 1, wherein the downward angle comprises a 45 degree angle.

6. The modular training system of claim 1, wherein when the exercise structure is connected to the system container, the exercise structure does not contact the ground surface.

7. The modular training system of claim 1, wherein the exercise structure further comprises at least one of a pull-up bar, a dip bar, a climbing rope, a weight/bench support, a universal weight system, a bungee hook, a jumping platform, a treadmill, an elliptical, and a stair climber.

8. A modular training system, comprising:

a system container including a container front, a container rear, a container first side, a container second side, a container bottom, and a container top, wherein the container front, the container rear, the container first side, the container second side, the container rear, and the container top define a container cavity;

an exercise structure comprising:

at least one platform connector comprising:

an interior vertical support bar coupled to an interior surface of the system container;

an interior horizontal support bar coupled to the interior vertical support bar and disposed within the container cavity;

an exterior horizontal bar coupled to the interior vertical support bar and extending external to the system container via an aperture defined by the system container; and an exterior vertical support bar coupled to the horizontal bar external to the system container.

9. The modular training system of claim 8, wherein the exterior vertical support bar is coupled to the container ceiling and the container floor.

10. The modular training system of claim 8, wherein the horizontal bar does not contact the system container.

11. The modular training system of claim 8, wherein the exercise structure further comprises at least one of a pull-up bar, a dip bar, a climbing rope, a weight/bench support, a universal weight system, a bungee hook, a jumping platform, a treadmill, an elliptical, and a stair climber.

12. A modular training system, comprising:

a system container including a container front, a container rear, a container first side, a container second side, a container bottom, and a container top, wherein the container front, the container rear, the container first side, the container second side, the container rear, and the container top define a container cavity;

an exercise structure comprising:

at least one platform connector comprising:

a mounting plate coupled to the system container;

a first member coupled to the mounting plate and extending away from the mounting plate and at a downward angle relative to the mounting plate;

a second member coupled to the first member and the mounting plate and extending away from the mounting plate at an upward angle relative to the mounting plate; and a support arm coupled to the first member and the second member and extending perpendicularly away from the mounting plate; and an exterior vertical bar coupled to the at least one platform connector via a horizontal bar and comprising a telescoping foot configured to not be contact with a support surface when in a retracted state, and to be in contact with the support surface when in an extended state, wherein the system container rests on the support surface.

* * * * *